US005384040A

United States Patent [19]

Mank et al.

[11] Patent Number: 5,384,040

[45] Date of Patent: Jan. 24, 1995

[54] PROCESS FOR THE ELIMINATION OF MERCURY AND POSSIBLY ARSENIC FROM HYDROCARBONS

[75] Inventors: Larry Mank, Orgeval; Yves Barthel; Charles Cameron, both of Paris; Patrick Sarrazin, Rueil Malmaison, all of France

[73] Assignee: Institute Francais Du Petrole, Rueil-Malmaison, France

[21] Appl. No.: 7,682

[22] Filed: Jan. 22, 1993

[30] Foreign Application Priority Data

Nov. 24, 1992 [FR] France ..... 92 14224

[51] Int. Cl.[6] ..... C10G 67/06; C10G 25/00

[52] U.S. Cl. ..... 208/251 R; 208/251 H; 208/301; 208/303; 585/823

[58] Field of Search ..... 208/251 R, 251 H, 301, 208/303; 585/823

[56] References Cited

U.S. PATENT DOCUMENTS

| | | | |
|---|---|---|---|
| 4,911,825 | 3/1990 | Roussel et al. | 208/251 R |
| 4,986,898 | 1/1991 | Torihata et al. | 208/303 |
| 5,062,948 | 11/1991 | Kawazoe et al. | 208/187 |

FOREIGN PATENT DOCUMENTS

| | | |
|---|---|---|
| 04011691 | 1/1992 | Japan . |
| 89/3265 | 4/1990 | South Africa . |
| WO90/10684 | 9/1990 | WIPO . |

OTHER PUBLICATIONS

Derwent Abstract of JP 3,026,790, Feb. 5, 1991.

Sarrazin et al., "Arsenic and Mercury Removal from Hydrocarbons Streams," presented at AIChE Spring National Meeting, New Orleans, La., Mar. 29–Apr. 2, 1992, Session No. 86, 16 pp.

*Primary Examiner*—Asok Pal
*Assistant Examiner*—Walter D. Griffin
*Attorney, Agent, or Firm*—Millen, White, Zelano & Branigan

[57] ABSTRACT

A process for the elimination of mercury and possibly of arsenic from hydrocarbons wherein compounds containing mercury are transformed into elemental mercury, the charge is fractioned, and then the fractions rich in mercury are purified through contact with a mercury collecting mass.

14 Claims, No Drawings

PROCESS FOR THE ELIMINATION OF MERCURY AND POSSIBLY ARSENIC FROM HYDROCARBONS

BACKGROUND OF THE INVENTION

The present invention is concerned with the elimination of mercury and possibly arsenic from hydrocarbons. More particularly, the invention relates to a process for which the compounds containing mercury in the charge to be treated are converted into elementary mercury, the charge is fractioned into cuts which are rich in and deprived of mercury, and the cuts containing mercury are then purified through contact with a mercury collecting mass.

It is known that liquid condensates (by-products of gas production) and some crude petroleums can contain a number of metal compounds in trace form and often in the form of organometallic complexes. These metal compounds are very often poisons for catalysts used during the transformation of these cuts into commercial products. Mercury is particularly toxic for the activity of precious metals, and moreover is a corrosive force with aluminium pieces, joints and solders.

Therefore it is advantageous to purify the charges intended to be used in condensate or crude oil transformation processes in order to prevent mercury, and possibly arsenic, from being entrained therein. Purification of the charge upstream of the treatment processes makes it possible for the entire installation to be protected.

The processes heretofore proposed by the Applicant show good demercurisation and de-arsenification performance with the liquid hydrocarbons used as charges in the various treatment processes. U.S. Pat. No. 4,911,825 belonging to the Applicant clearly shows the advantage of collecting mercury and possibly arsenic in a two stage process. The first stage consists in contacting the charge in the presence of hydrogen with a catalyst which contains at least one metal from the group formed by nickel, cobalt, iron and palladium. Mercury is not collected (or not much of it is collected) by the catalyst, but it is activated on the catalyst in such a way as to be collected in the second stage by a mass containing sulphur or sulphur compounds. Patent application WO-90/10684 belonging to the Applicant describes a process for the elimination of mercury and possibly arsenic from liquid hydrocarbons. This invention is concerned with catalysts which have the capacity to withstand sulphur poisoning (thio-resistance). These new catalysts make it possible for mercury and arsenic to be collected when conditions are too severe for the catalysts described in the prior art. They not only contain at least one metal from the group formed by Ni, Co, Fe, Pd but also at least one metal selected from the group formed by chromium, molybdenum, tungsten and uranium.

The process described in this patent is particularly useful for purifying difficult charges such as gas oils originating from fractionation of a crude petroleum wherein the sulphur content is often between 0.4 and 1.0% by weight. On the other hand, the process described in U.S. Pat. No. 4,911,825 performs better with charges with a lower sulphur content, less than 0.15% by weight, for example.

SUMMARY OF THE INVENTION

The present invention relates more specifically to a process for the elimination of mercury, and possibly arsenic, wherein the mercury in the compounds present in the hydrocarbon charge to be purified is transformed into elementary mercury in a first step. The effluent from this step is fractioned into at least two cuts defined by their initial and end boiling temperatures. The cuts rich in mercury (that is to say with a residual content above that which is acceptable for subsequent use, the acceptable content hereinafter being called "maximum admissible content"), are contacted with the mercury collecting mass(es) in a second step. The cuts deprived of mercury (with a mercury content less than or equal to the acceptable content for subsequent use) can be used directly.

The mercury containing compounds can be transformed, for example:

- by a non catalytic heat treatment (for example by heating the charge to be treated to a temperature above 180° C.) or a catalytic heat treatment (without hydrogen) enabling the bonds between the mercury, and, for example, between the hydrocarbon radicals, to be broken and elemental mercury to be obtained and the by-products of these radicals, or
- by catalytic conversion in the presence of hydrogen (or of compounds containing incipient hydrogen) added beforehand to the charge, enabling hydrogenolysis, for example, to take place of the organomercuric complexes into elemental mercury and of the hydrocarbons.

Preferably, the compounds containing mercury are transformed into elemental mercury by a catalytic process in the presence of hydrogen.

It has been shown that the direct collection of mercury in some transformation charges such as gas condensates is not possible because they have a great variety of mercury containing compounds. The compounds in organometallic form cannot be substantially collected by mercury collecting masses. Therefore, it is necessary to transform them into elementary mercury for collection to be effective.

A Patent application JO3026790-A describes a process wherein the liquid charge undergoes a heat treatment at at least 200° C. to convert the compounds containing mercury into elemental mercury, and the elemental mercury is then collected by a mercury collecting mass with a metal sulphide base (Mo, Co . . . ).

If a charge of this kind is fractioned before the mercury compounds are transformed into elementary mercury, no advantage is gained because these compounds which are very varied contaminate all the cuts with mercury. This is shown by the distribution of mercury in some condensates of the natural gas where more than 29% mercury has been found in fractions with a boiling temperature above 170° C., see for example the article by P. Sarrazin et al., AIChE Spring Nat. Meeting, Session 86, New Orleans, 29 Mar. 1992.

It has now been discovered that the distribution of mercury in the effluent from the first step of the demercurisation process is completely different from that in the charge of the process. When the various mercury compounds are transformed into elemental mercury, there is a significant increase in the concentration of mercury in the light cuts and a reduction in the concentration of mercury in the heavy cuts. This change in the distribution of mercury is totally unexpected because owing to the fact that the boiling temperature of the metal mercury is 356° C., the mercury ought to be concentrated in the heavy fraction.

Thus, the process according to the present invention comprises a step for transforming the mercury compounds into elemental mercury. This step is carried out in a temperature range which can be between 120° and 400° C., more advantageously 130° to 250° C. and preferably 140° to 220° C. The operating pressures are preferably selected between 1 to 60 bars and more advantageously between 5 and 40 bars, and yet more preferably between 15 and 35 bars. The flow rate of hydrogen, when hydrogen is used, in relation to the catalyst is between 1 and 500 volumes, for example (gas under normal conditions) per volume of catalyst per hour.

When this step is carried out by way of a catalytic process, a preferred catalyst is that composed of at least one element M selected from the group formed by iron, nickel, cobalt, molybdenum, tungsten and palladium. The metal M must either have 20% of the total amount of M in reduced form or have at least 5% of the total amount of M in sulphur form. Nickel, cobalt, tungsten and/or molybdenum are preferably used.

The solid mineral dispersant (catalytic support) can be selected from the group formed by alumina, silica-aluminas, silica, zeolites, active carbon, clays and aluminous cements. It preferably has a large surface area, an adequate porous volume and an adequate mean pore diameter. The BET surface area will have to be greater than 50 $m^2/g$ and preferably between about 100 and 350 $m^2/g$. The support will have to have a porous volume, measured by desorption of nitrogen, of at least 0.5 $cm^3/g$ and preferably between 0.6 and 1.2 $cm^3/g$ and a mean pore diameter of at least 70 Å and preferably greater than 80 Å.

The effluent from this transformation step of the mercury compounds into elemental mercury is then fractioned into two or more cuts. The light cut(s) is/are contacted with at least one mercury collecting mass in gaseous phase or in liquid phase where the content of elemental mercury is greater than the maximum admissible content. Generally speaking, the cuts with an initial boiling temperature of more than 40° C. are treated in liquid phase.

The heavier fractions (with an initial boiling temperature of more than 180° C., for example) are valorised directly when their content of elemental mercury is less than the maximum admissible content.

The maximum admissible content of elementary mercury is a predetermined value which is selected in view of corrosion effects, and quality of the products desired, or it can be fixed by national ruling within the scope of environmental protection, for example.

Thus, the elemental mercury according to the invention is mainly found in the fraction(s) which have an initial boiling point of less than 180° C. and most frequently less than 160° C. The fractionation operation is carried out according to rules laid down by those skilled in the art, and the manufacturer selects the number of cuts and cutting points depending on production criteria. The mercury collecting masses in the process of the invention can all be those which are known to those skilled in the art of collecting elemental mercury in hydrocarbon liquid phase. As far as collecting mercury in gaseous phase is concerned, all the elemental mercury collecting masses known to those skilled in the art are acceptable. One or a plurality of collecting masses which are the same or different can be used for one and the same cut or for different cuts.

Depending on the amounts of mercury and/or arsenic (calculated in elemental form) contained in the charge, the volumetric ratio of catalyst to collecting mass can vary between 1:10 and 5:1.

To ensure that the collection of mercury is properly effective, the temperature at which the collecting is carried out is less than 220° C., preferably less than 180° C. and more preferably less than 120° C. The spatial speeds calculated for the collecting mass can be between 1 and 50 $h^{-1}$ and more particularly between 1 and 30 $h^{-1}$ (volume of liquid per volume of mass per hour=VVH).

The invention is applicable, in particular, to charges containing $10^{-3}$ to 5 milligrams mercury per kilogram of charge (mg/kg or ppm) and 0 to 5 milligrams arsenic per kilogram of charge, and 0 to 4% by weight of total sulphur.

A major advantage of the invention is that it allows caloric energy to be used from the effluent from the transformation step of the mercury compounds.

In fact, the effluent comes from the transformation step at a temperature of between 120° and 400° C., and more usually between 140° and 220° C. In processes prior to the invention, the effluent had to be cooled before it arrived at the mercury collecting mass, the collecting reaction being carried out at less than 220° C. and more usually at less than 120° C. (a preferred value being on the order of 70° C.).

According to the invention, the issuing effluent is fractioned. The caloric energy needed for this operation is provided to a large extent by the effluent itself.

The light fraction(s) issuing which pass over the collecting mass have temperatures of less than 220° C., more usually less than 180° C., and still better less than 160° C.

Thus, it is not necessary to cool the entire effluent from the transformation step.

The process according to the invention enables the heat balance to be better integrated.

Another advantage of the present invention is the reduction in volume of the charge to be treated on the mercury collecting mass. Thus, lighter equipment can be provided, resulting in substantial gains as far as cost is concerned.

It is also possible to note the flexibility of this process which enables cuts to be selected, and, if necessary, for some of them to be treated after they have passed over the collecting mass. This is the case, for example, with the cut 60°–160° C. cut which can undergo steam-cracking or re-shaping.

The following examples illustrate the process by way of example, without however limiting the scope thereof.

EXAMPLES

Catalyst: Fifteen kilograms of a macroporous alumina support in the form of balls 1.5-3 mm in diameter and with a specific surface area of 160 $m^2/g$, a total porous volume of 1.05 $cm^3/g$ and a macroporous volume (diameter>0.1 μm) of 0.4 $cm^3/g$ are impregnated with 20% by weight of nickel in the form of an aqueous nitrate solution. After being dried at 120° C. for 5 hours and after thermal activation at 450° C. for 2 h with air sweeping over it, balls are obtained which contain 25.4% by weight of nickel oxide. Five kilograms of these balls are impregnated dry with a solution containing 175 g of DEODS diethanol disulphide (74 g of which is sulphur) in 5150 $cm^3$ of a solution of 15%, methyl formate in a white spirit. The catalyst thus prepared is activated at 150° C. for 1 h.

Collecting mass: Fifteen kilograms of the support used in preparing catalyst A are impregnated with 10% by weight of copper in the form of an aqueous solution of trihydrated copper nitrate. After drying at 120° C. for 5 h and thermal actuation at 450° C. for 2 h with air sweeping over it, balls are obtained containing 12.5% by weight copper oxide. These balls are then impregnated with a solution of 10% by weight of ammonium sulphide. The product is activated at 120° C. for 2 h with a current of nitrogen. This mass has been used in the reactor II for all the examples below.

Example 1 (Comparative)

The reactor was charged with 50 $cm^3$ of the mercury collecting mass. A heavy condensate of gas liquefied with nitrogen is then passed over the collecting mass in ascending flow. The flow rate of the charge is 400 $cm^3/h$ and that of the nitrogen is 3.5 l/h. The test was carried out at 20° C. at a pressure of 35 bars.

The condensate used during this test has the following features:

initial boiling point: 21° C.
final boiling point: 491° C.
mercury content: 2210 μg/kg
arsenic content: 80 μg/kg
sulphur content: 117 mg/kg The test was carried out for 5 days and gave very low performance rates of mercury collection between 27 and 5%. The arsenic content in the effluent was between 60 and 75 μg/kg. Therefore, an elemental mercury collecting mass was not very effective for direct purification of the crude charges.

Example 2 (Comparative)

The test was carried out with two reactors in series: a reactor 1 in which the catalyst (50 $cm^3$) was placed and a reactor II, downstream of the reactor I, in which the collecting mass (50 $cm^3$) was placed. The catalyst functions at 180° C., and the mercury collecting mass functions at 20° C. The flow is ascending in the two reactors. The catalyst was reduced to 300° C. at a flow rate of 20 l/h of hydrogen at 2 bars pressure for 6 h. Then, the reactor was cooled to the reaction temperature of 180° C. A heavy condensate of liquefied gas with the hydrogen was then passed over the catalyst, and the effluent obtained was contacted with the collecting mass. The flow rate of the charge was 400 $cm^3/h$ and that of the hydrogen was 3.5 l/h. The test was carried out at 35 bars pressure. The condensate used during this test was identical to that of the previous test.

The results of this test show an efficiency of mercury collecting which is at least greater than 98.4% for the 21 days of the test. It is also noted that the content of arsenic in the effluent is less than the detection limit (<5 μg/kg) during the entire duration of the test. Therefore, partial purification of the charge is possible with this treatment.

Example 3 (According to the Invention)

As in the previous test, the catalyst was charged into the reactor I, reduced as indicated hereinabove, and then cooled to 180° C. The heavy condensate with hydrogen was then passed over the catalyst, under the same conditions as those of Example 2.

The effluent was cooled to 22° C. and depressurised to atmospheric pressure. The effluent from this first step was then fractioned in three cuts:

<60° C. representing 12.7% by weight of charge (density equal to 632 $kg/m^3$), mercury content of 233 μg/kg, undetected arsenic (<5 μg/kg)

between 60° and 160° C. representing 54.1% by weight of the charge (density equal to 768 $kg/m^3$), mercury content 3829 μg/kg, undetected arsenic, and >160 ° C. representing 33.1% by weight of the charge (density equal to 836 $kg/m^3$), mercury and undetected arsenic (<5 μg/kg). (Owing to the dilution factor needed to make this cut acceptable for mineralization the mercury detection limit (<10 μg/kg) is higher than in the other instances).

The <60° C. and 60 °-160° C. cuts which are polluted by elemental mercury are placed in contact with the mercury collecting mass.

Two reactors are charged with 50 $cm^3$ of mercury collecting mass. The same procedure is followed as in Example 1. The tests are carried out:

at 20° C. with a charge flow rate of 100 $cm^3/h$ for the light cut (<60 ° C.) and at 70° C. and at a flow rate of 400 $cm^3/h$ for the intermediate cut (60°-160 ° C.).

The effluents from the treatment of the light cut were analysed after 5 h of treatment. No presence of mercury was detected in the effluent (<1 μg/kg). Likewise, the analyses made of the effluents from the intermediate cut after 6 h of the test did not reveal any presence of mercury (<1 μg/kg). Example 3 shows that, contrary to the simple hypothesis about the boiling point of the elemental mercury, integrating a conversion stage of the mercury containing compounds into elemental mercury (and possibly collection of arsenic), fractioning and mercury collection in the light cuts made it possible to purify the entire charge by one single treatment of the lightest fractions in the effluent from the first stage (66.9% of the entire charge).

We claim:

1. A process for the elimination of mercury from a liquid hydrocarbon charge, comprising transforming the mercury contained in the compounds of the charge into elemental mercury, fractionating the effluent resulting from said transformation into at least two separate cuts with different mercury contents, at least one cut having an initial boiling point below 180° C. and having a mercury content above a maximum permissible content, and at least one cut having a boiling point above 180° C. and having a reduced mercury content, and contacting said at least one cut boiling below 180° C. with at least one mercury collecting mass.

2. A process according to claim 1, characterised in that the transformation step takes place between 120° and 400° C. and at a pressure of 1 to 60 bars.

3. A process according to claim 1, wherein the transformation step is a non-catalytic heat treatment conducted at a temperature effective for the transformation and in the absence of hydrogen.

4. A process according to claim 1, wherein the transformation step is a heat treatment conducted at a temperature effective for the transformation, in the presence of a catalyst and in the absence of hydrogen.

5. A process according to claim 1 wherein the transformation step is a catalytic conversion in the presence of hydrogen, at a rate of 1 to 500 volumes of gas under normal conditions per volume of catalyst per hour.

6. A process according to claim 4, wherein the catalyst comprises at least one element M which is iron, nickel, cobalt, molybdenum, tungsten or palladium, and at least 20% (by weight) M in reduced form, and the catalyst also comprises a solid support which is alumina, silica-alumina, silica, a zeolite, active carbon, a clay or an aluminous cement.

7. A process according to claim 4, wherein the catalyst comprises at lease one element M which is iron, nickel, cobalt, molybdenum, tungsten and palladium and at least 5% (by weight) of M in the form of sulphur, and the catalyst also comprises a solid support which is alumina, silica-alumina, silica, a zeolite, active carbon, a clay or an aluminous cement.

8. A process according to claim 1, wherein contacting with the collecting mass(es) takes place at a temperature which is less than 220° C., at a volume of liquid per volume of mass per hour of 1 to 50 $h^{-1}$.

9. A process according to claim 1, wherein the volumetric ratio of catalyst used in the transformation step to the collecting mass(es) varies between 1:10 and 5:1.

10. A process according to claim 1, wherein the charge to be treated contains $10^{-3}$ to 5 mg mercury per kg of charge.

11. A process according to claim 1, wherein the charge to be treated contains from 0 to 5 mg arsenic per kg of charge.

12. A process according to claim 1, wherein the charge to be treated contains from 0 to 4% by weight of sulphur.

13. A process according to claim 1, wherein said at least one cut boiling above 180° C. is not contacted with a mercury collecting mass.

14. A process according to claim 1, wherein the mercury content of the cut having a boiling point above 180° C. is below the maximum permissible content.

* * * * *